US010058169B2

(12) United States Patent
Gorelick

(10) Patent No.: US 10,058,169 B2
(45) Date of Patent: Aug. 28, 2018

(54) HAIR BRUSH SANITIZING UNIT

(71) Applicant: Hillel Ulysses Gorelick, Forest Hills, NY (US)

(72) Inventor: Hillel Ulysses Gorelick, Forest Hills, NY (US)

( * ) Notice: Subject to any disclaimer, the term of this patent is extended or adjusted under 35 U.S.C. 154(b) by 91 days.

(21) Appl. No.: 14/972,290

(22) Filed: Dec. 17, 2015

(65) Prior Publication Data

US 2016/0302567 A1 Oct. 20, 2016

Related U.S. Application Data

(63) Continuation of application No. 14/017,196, filed on Sep. 3, 2013, now abandoned.

(60) Provisional application No. 61/695,820, filed on Aug. 31, 2012.

(51) Int. Cl.

| | |
|---|---|
| ***A46B 17/06*** | (2006.01) |
| ***B08B 7/00*** | (2006.01) |
| ***A46B 9/02*** | (2006.01) |

(52) U.S. Cl.

CPC ..... *A46B 17/065* (2013.01); *A46B 9/023* (2013.01)

(58) Field of Classification Search

CPC ..... A46B 17/065; A46B 9/023

See application file for complete search history.

(56) References Cited

U.S. PATENT DOCUMENTS

| | | | | |
|---|---|---|---|---|
| 5,029,252 | A * | 7/1991 | Ameseder | A61L 2/10 250/455.11 |
| 5,652,991 | A * | 8/1997 | Kashani | A45D 24/46 15/38 |
| 7,213,603 | B2 * | 5/2007 | Pinsky | A45D 44/18 132/310 |
| 9,622,629 | B1 * | 4/2017 | Brittain | A47K 11/10 |
| 2006/0175554 | A1 * | 8/2006 | Riddell | A61L 2/10 250/455.11 |
| 2011/0284024 | A1 * | 11/2011 | Trebella | A46B 13/04 134/1 |
| 2013/0004367 | A1 * | 1/2013 | Roberts | A61L 2/10 422/24 |
| 2013/0047357 | A1 * | 2/2013 | Diaz | A46B 11/002 15/104.94 |
| 2014/0096801 | A1 * | 4/2014 | McCormick | B08B 11/02 134/115 R |
| 2014/0166900 | A1 * | 6/2014 | Nelson | A61L 2/10 250/455.11 |
| 2014/0246044 | A1 * | 9/2014 | Levy | A46B 15/0091 132/313 |

(Continued)

*Primary Examiner* — Michael E Barr
*Assistant Examiner* — Benjamin L Osterhout
(74) *Attorney, Agent, or Firm* — Michael L. Greenberg, Esq.; Greenberg & Lieberman, LLC

(57) ABSTRACT

A device for sanitizing and disinfecting hair styling tools such as hair brushes via ultraviolet radiation is described. The device is preferably equipped with a chamber disposed in a body equipped with a housing and a base. At least one UV bulb is disposed within the base, and is configured to cast UV light to a tool disposed within the chamber. Reflectors orient the emitted UV light such that the maximal surface area of the brush head is sanitized via the at least one UV bulb. The device is conventionally powered, and is configured to preferable deactivate automatically at the end of the sanitizing process.

8 Claims, 8 Drawing Sheets

(56) References Cited

U.S. PATENT DOCUMENTS

| | | | | |
|---|---|---|---|---|
| 2014/0319375 | A1* | 10/2014 | Nelson | A61L 2/025 250/455.11 |
| 2015/0008336 | A1* | 1/2015 | Rubinchikov | A61L 2/10 250/455.11 |
| 2015/0069263 | A1* | 3/2015 | Moyal | A61L 2/10 250/455.11 |
| 2015/0209457 | A1* | 7/2015 | Bonutti | A61L 2/10 250/435 |
| 2015/0216294 | A1* | 8/2015 | Mongan | A46B 17/065 15/105 |
| 2015/0374467 | A1* | 12/2015 | Nazeri | A61C 17/26 15/22.1 |

* cited by examiner

HAIR BRUSH SANITIZING UNIT

CONTINUITY

This application claims priority to U.S. non-provisional application Ser. No. 14/017,196 filed on Sep. 3, 2013, which in turn claimed priority to U.S. provisional application 61/695,820 filed on Aug. 31, 2012, the entire contents which are incorporated herein by reference.

FIELD OF THE PRESENT INVENTION

The present invention generally relates to sanitizing and disinfecting products and procedures, and more specifically relates to a hair brush sanitizing and disinfecting device configured to employ ultraviolet radiation to disinfect and sanitize a hair brush rapidly and safely.

BACKGROUND OF THE PRESENT INVENTION

Hair brushes, with their many and varied bristles and forms, are a difficult tool to adequately disinfect. Typically nylon or boar, the bristles scrape against skin, and pull through hair, gathering skin and skin born pathogens. It is not unusual for clients to have open sores or breaks in the skin of the scalp, allowing as well for the retrieval of bodily fluids, and potential diseases therein, onto said brush. The heat generated from blow drying, typically 50-130 degrees F., is not sufficient to sanitize, and many organisms will survive/persist beyond said heat. As well, Barbacide, mixed in the recommended ratio of 2 ounces to 32 ounces water, is not an ideal means of sanitizing a hairbrush. The continued chemical and liquid exposure would be damaging to the brush, and the brush would be sopping wet with Barbacide, a toxic chemical that would then be heated, vaporized, and inhaled on a regular basis. As well, the client's skin would receive an excess of this potential irritant/toxin.

The challenge of sanitizing/disinfecting hair brushes has gone largely unchecked by hair salons and their employees. The sanitizing and disinfecting of hair brushes, and other tools particular to the art, is typically neither attempted, nor accomplished. The result is a brush that has gone through hundreds if not thousands of clients' heads without any cleaning-beyond removing excess hair. This problem is compounded by the typical storage of brushes in close proximity to one another, thus leading to cross contamination. There is a void of understanding, both by the salon team, and the average client, as to the extent of diseases, like MRSA, Hepatitis, flu, and various fungal infections, that can quite easily be spread by hair salon tools.

There are chemical spray disinfectants present on the market, which may be employed to partially disinfect a hair brush, but are rarely, if ever used. These chemical disinfectants are both displeasing and unhealthy to inhale, and are always potentially irritating to the skin, especially to individuals with skin sensitivities. In addition, to achieve set sanitizing standards of 99.9% and above, a hairbrush would have to be truly saturated with chemical spray disinfectant, including the handle, and left to sit for at least 10 minutes (chemical sanitizing time standard,) which is unrealistic at best. In real salon use, the typically quick and partial random application of such chemical sprays produces sub-standard results.

Presently, there are UV light "boxes," used in nail salons for sanitizing instruments. Often these are toaster/microwave ovens that have been retrofitted with UV bulbs, or similarly sized devices for same said purpose. These devices are typically not used in hair salons for several reasons. First, there has not been a demand for their use by the clientele, nor enough education to raise awareness for the need. The devices are often too large and unsightly for a typical salon station, where space is often limited. Likewise, the introduction of a large sanitizing device would invite sanitizing of multiple brushes simultaneously, which depending on design, likely creates several problems. As efficacy of UV light is dependent on reaching all surface areas requiring disinfection, brushes on/next to other brushes creates "shading," allowing resistant viruses/bacteria to effectively hide from sanitizing light, reducing efficacy of the process.

To mitigate cost, a unit that holds several brushes would unfortunately invite salons to purchase fewer "shared" units, as multiple stylists could use the same device simultaneously. However, such a shared arrangement presents issues of lost or borrowed brushes, as well as forcing stylists to leave their stations repeatedly throughout the day in order to sanitize and retrieve hair brushes or other implements. This would likely lead to a significant decrease in the frequency of use of such a device, further subjecting the population to continued needless exposure to harmful pathogens. Therefore, a small, personalized sanitizing unit that can be placed at each stylist's station, occupying a minimal footprint, is the ideal.

To further ensure its use, there is a need for a sanitizing device that can quickly and easily be operated by a hairdresser. For example, when holding a blow dryer in one hand, and a brush in a second hand, it would be desirable for the hairdresser to be able to operate a unit with one finger.

http://prefundia.com/projects/view/brush-medic-makeup-brush-dryer-and-uv-sterilizer/3228/ shows a brush medic makeup brush dryer and UV sterilizer. Unlike the present invention, the brush medic does not hold the entire brush, allowing organisms on the handle to avoid exposure to UV sanitizing. Also, it is not easily operated with one finger, and has a single uv light several inches away at the bottom of its chamber—a fact that guarantees a significantly longer than claimed 60 seconds for a sanitizing cycle if efficacy is to be achieved.

http://www.thehairandbeautycompany.ie/catalogue/crewe-orlando-sirius-sterilizer-p_3651—shows a sterilizer with a flip door. Unlike the present invention, the sterilizer with a flip door is a container that can be opened and closed, but does not have a particular holder for a brush, does not have reflectors, does not have a particular holder to ensure the brush or other hair styling tool receives more direct UV exposure, and does not have a slider for one finger operation.

http://www.salonspafurniture.com/pd-pibbs-495-sani-plus-sanitizer.cfm shows a sanitizer with an oven-like access. Unlike the present invention, the sanitizer does not have have a particular holder for a brush, does not have reflectors, does not have a particular holder to ensure the brush or other hair styling tool receives more direct UV exposure, and does not have a slider for one finger operation.

http://www.amazon.co.uk/Ultraviolet-Sterilzer-Sanitizer-Cabinet-Machinee/dp/B00GD45228 shows a sanitizer cabinet. Unlike the present invention, the sanitizer cabinet has a large footprint on a workstation, opens like a conventional toaster oven furthering it's footprint, and provides metallic grids that can shade said objects to be sanitized, preventing from receiving the optimal UV exposure.

Thus, clearly there is, and has long been a need for a new hair brush sanitizing and disinfecting device that safely utilizes UV light to sanitize and disinfect hair brushes and other implements in the field of hairdressing. Such a device would maximize sanitizing output in minimal space, encouraging its consistent use by design. Such a device is preferably configured to rapidly disinfect a hair brush via UV lamps, including UVC LED's, or other known or yet to be discovered UV outputting emitters.

SUMMARY OF THE PRESENT INVENTION

The present invention is a hair brush sanitizing device configured to disinfect all surfaces of a hair brush quickly and safely for re-use. The device has a body supported by a base, and is preferably powered via an AC power supply, however some embodiments of the present invention may be equipped with an internal rechargeable battery or provisioned for receiving conventional batteries. The body is equipped with a housing with an opening at the top, providing an access point to the interior of the body, referred to as the chamber. The device is preferably equipped with four ultraviolet lamps, disposed in the base of the device and extending vertically upwards, which are oriented to thoroughly saturate ultraviolet radiation within the chamber. Preferably, located directly behind and encompassing all four ultraviolet lamps is a reflective surface to ensure maximum irradiation within the chamber. A quartz or quartz-based barrier is preferably present within the chamber, and is preferably disposed between the ultraviolet lamps and the hair brush or other hair styling tool to be sanitized within the chamber. As such, the quartz barrier is preferably cylindrical, and is large enough to accept conventionally sized hair brushes and other hair styling tools. As compared to glass and clear plastics, whose properties of UV absorption and refraction weaken and/or eliminate UV efficacy, the quartz chamber is configured to optimize and allow 100% UV transmission.

The UV lamps of the present invention are preferably arranged in a cardinal or compass-like orientation, similar to North, South, East, and West, wherein each UV lamp is offset by 90 degrees from an adjacent UV lamp. Proven in preliminary engineering studies utilizing sophisticated light simulation software, and in lab testing on actual hair brushes, this arrangement ensures the narrowest-sized brush holding chamber, and narrowest reflector and overall dimensions, while maximizing UV saturation, and minimizing disinfection time. This arrangement of four, preferably 7 Watt bulbs and their associated UV output ensure effective sanitization of any hair styling tool placed within the chamber.

Additionally, the present invention is preferably configured to automatically deactivate the UV lamps at the end of the sanitizing and disinfecting process. Some embodiments of the present invention may enable the end-user to modify the duration of the sanitizing and disinfecting process or time. An LCD display may be disposed on the housing of the present invention, to facilitate the adjustment of duration settings, as well as to display remaining time of the sanitizing and disinfecting process during use. A sliding tab facilitating opening and closing of the device may be a further embodiment of the present invention.

BRIEF DESCRIPTION OF THE DRAWINGS OF THE PRESENT INVENTION

Figure 3:
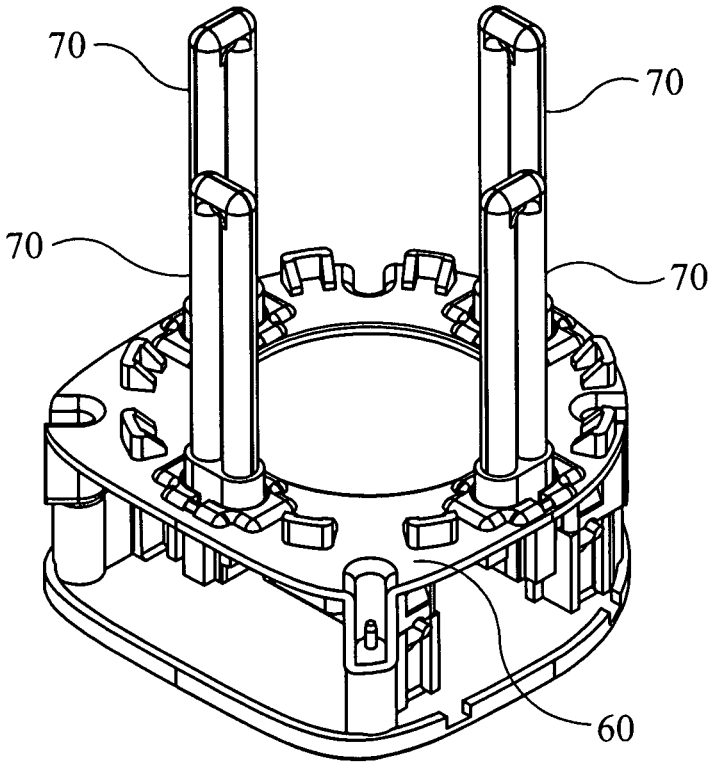

FIG. 3 exhibits a view of the base of the present invention independent of the housing.

Figure 4:
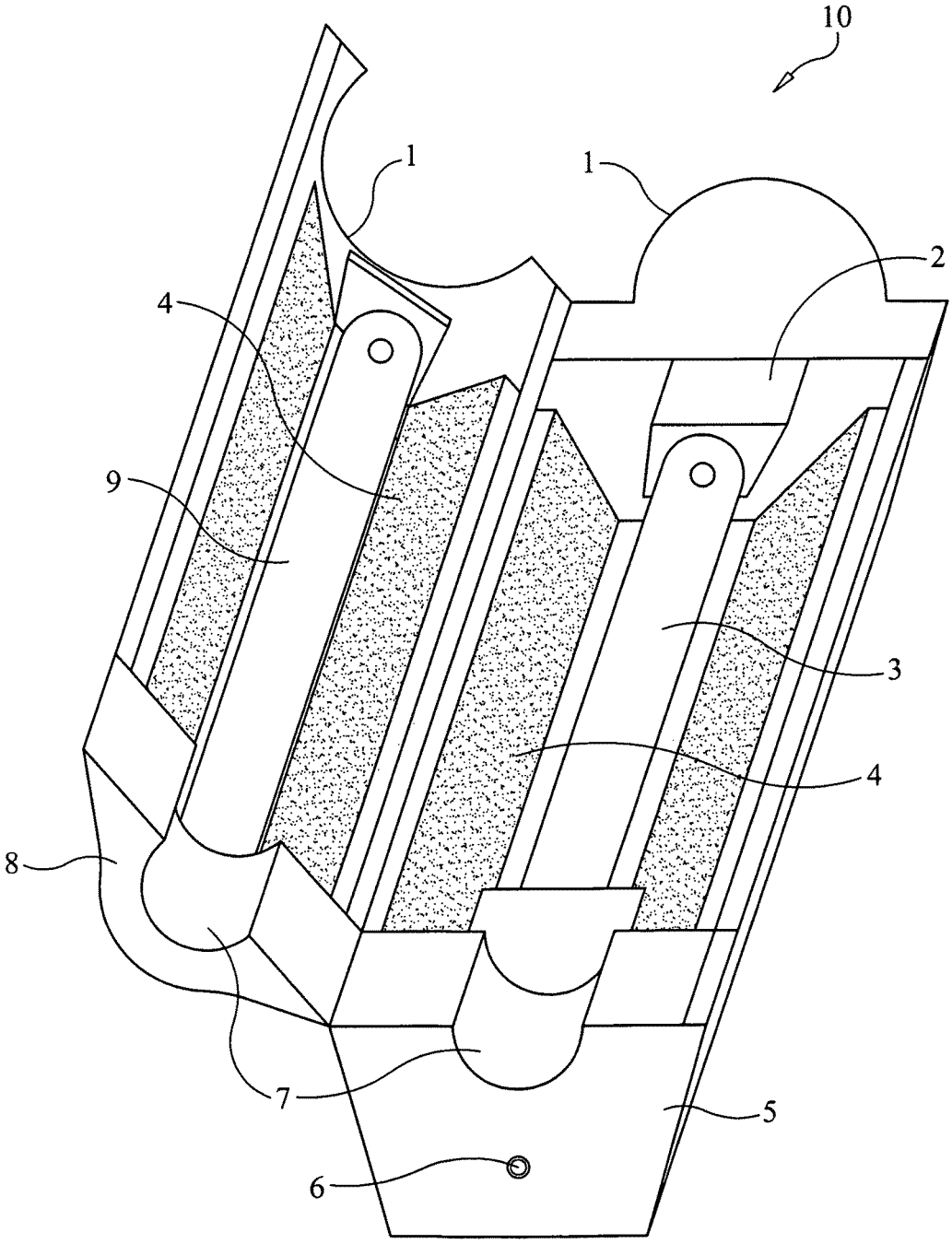

FIG. 4 displays an alternate embodiment of the present invention as seen from above and from a side.

Figure 5A:
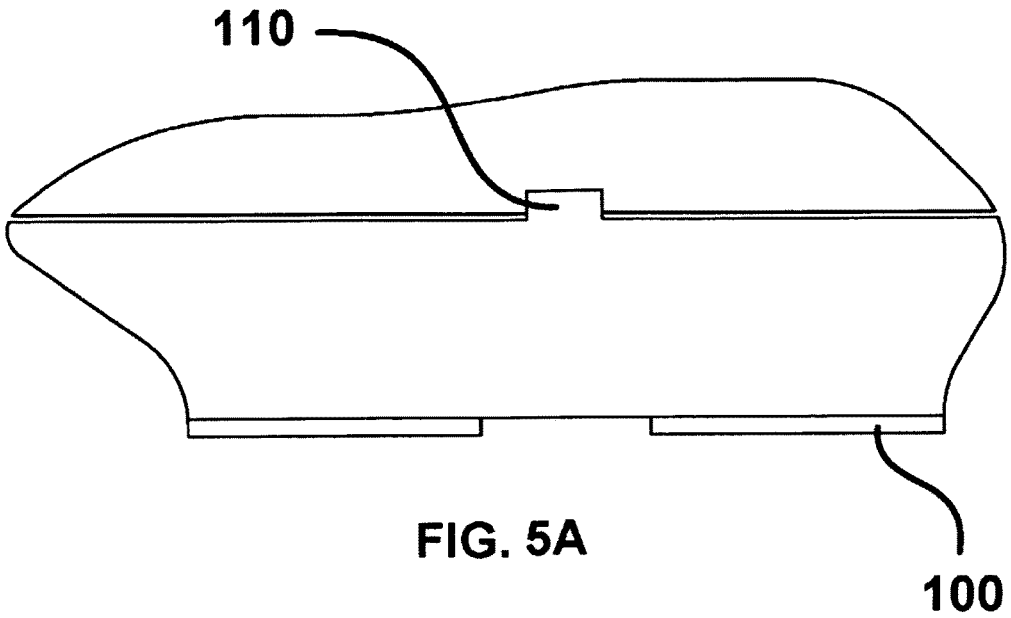

FIG. 5A displays a second alternate embodiment of the present invention as seen from the left side.

Figure 5B:
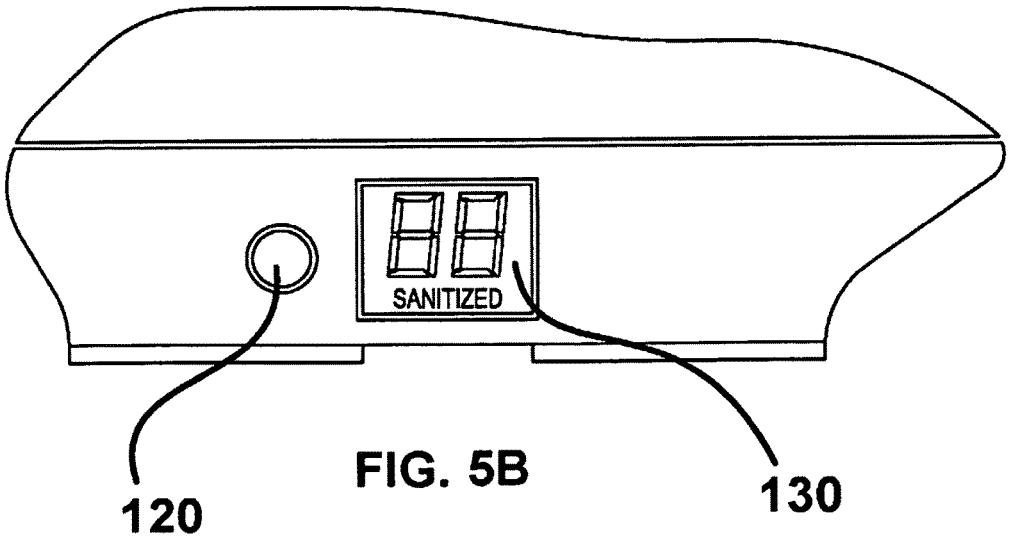

FIG. 5B exhibits the second alternate embodiment of the present invention as seen from the right side.

Figure 5C:
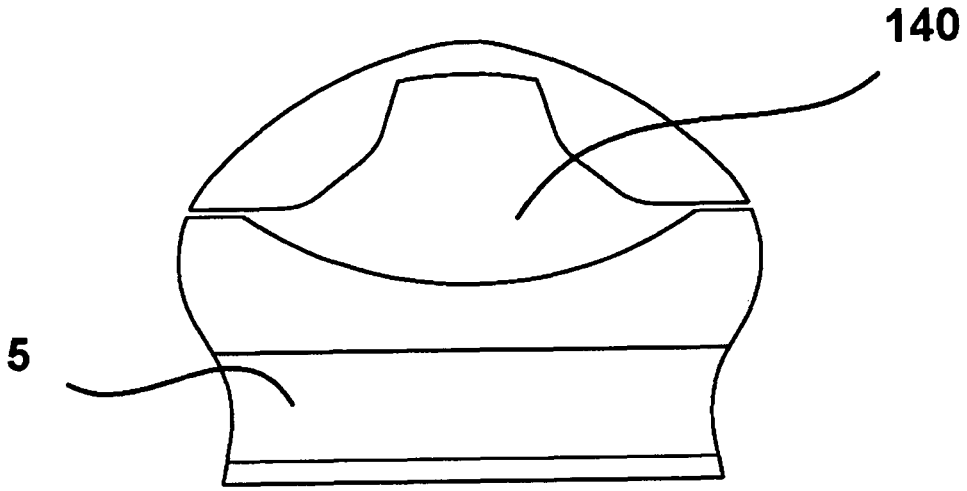

FIG. 5C shows the second alternate embodiment of the present invention as seen from the front.

Figure 5D:
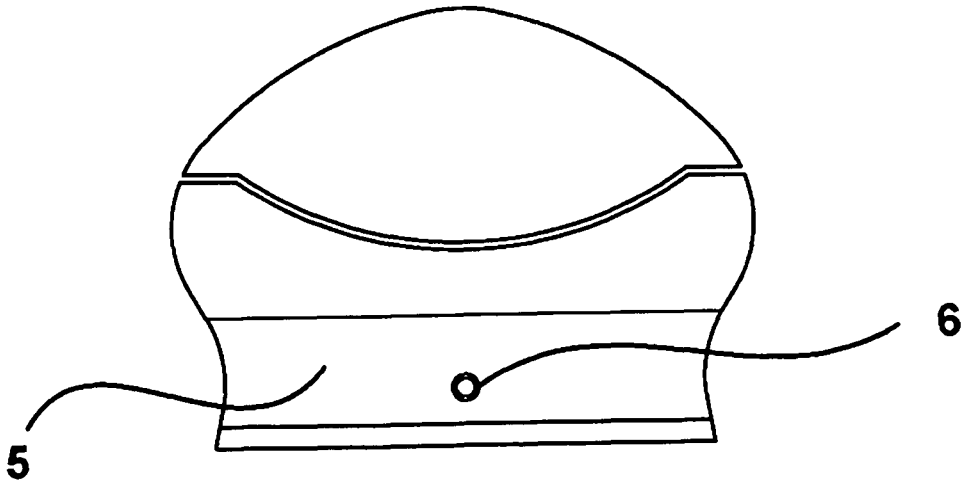

FIG. 5D depicts the second alternate embodiment of the present invention as seen from the rear.

Figure 6:
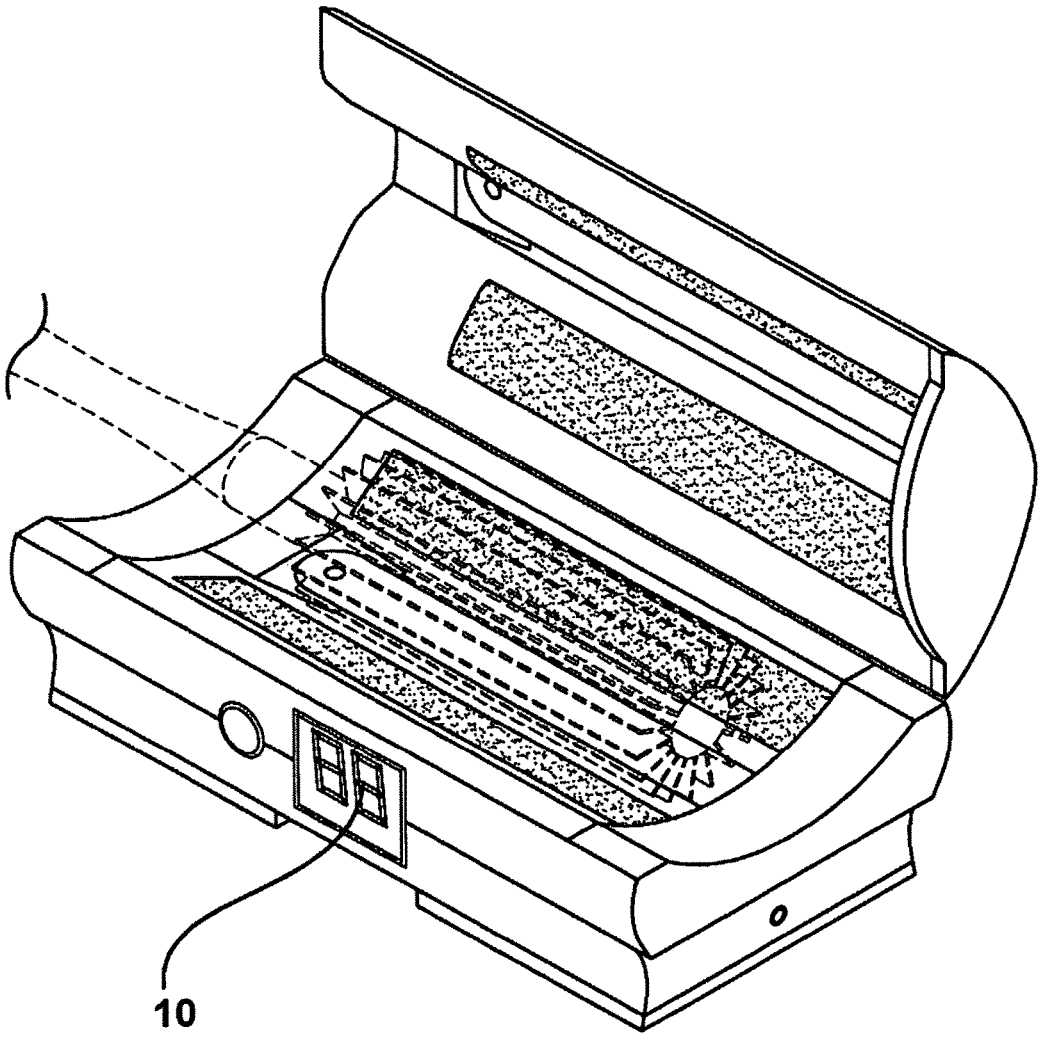

FIG. 6 shows an environmental view of a third alternate embodiment of the present invention for cleaning of the shown brush.

Figure 7:
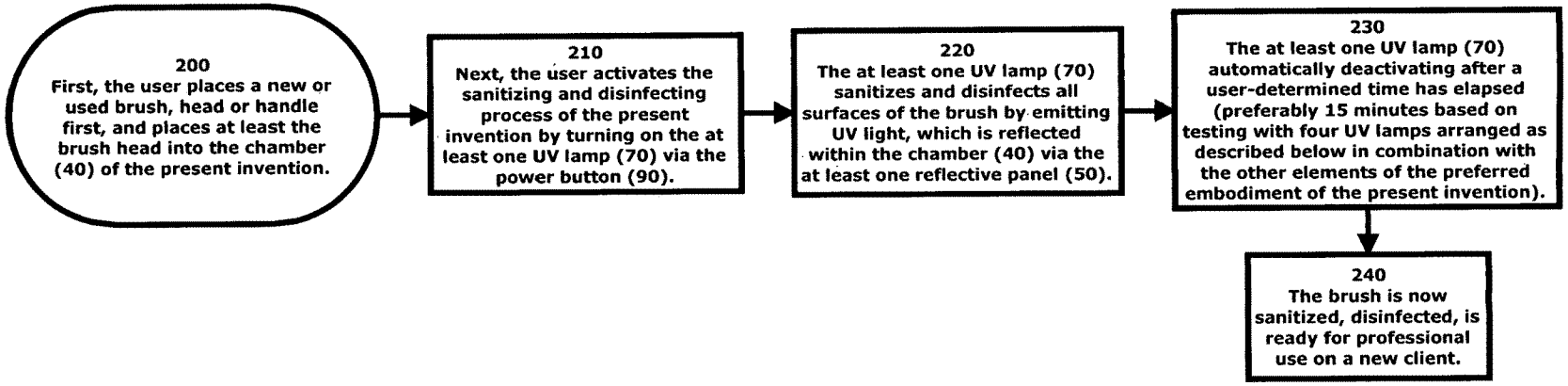

FIG. 7 shows a flow-chart detailing the preferred process of use of the present invention.

While the invention is described with reference to the above drawings, the drawings are intended to be illustrative, and the invention contemplates other embodiments within the spirit of the invention.

DETAILED DESCRIPTION OF THE PRESENT INVENTION

From time-to-time, some embodiments of the invention are described herein in terms of example environments. Description in terms of these environments is provided to all of the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications, and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
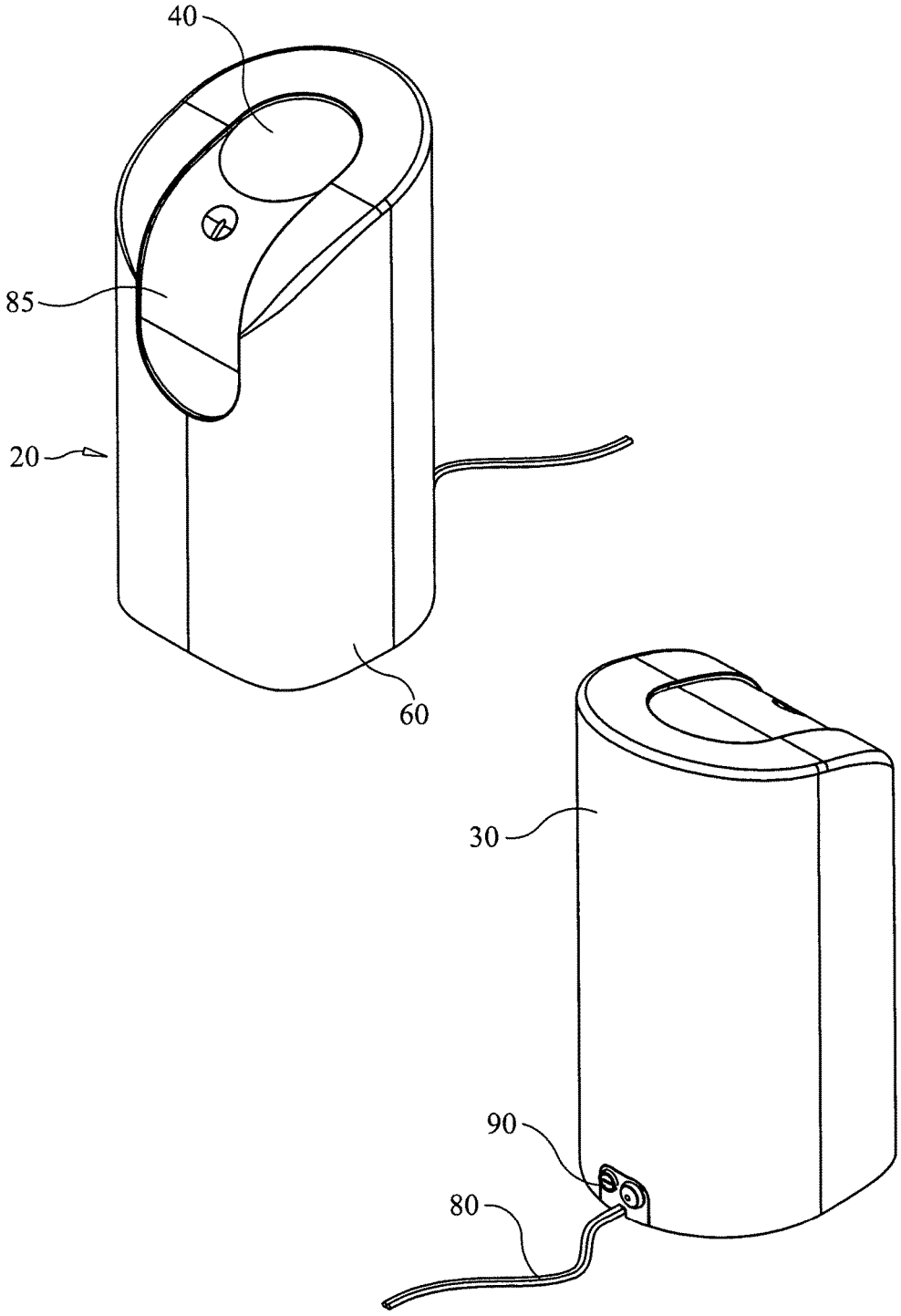
FIG. 1 shows the preferred embodiment of the present invention as seen from the front corner and from the rear corner.
Figure 2:
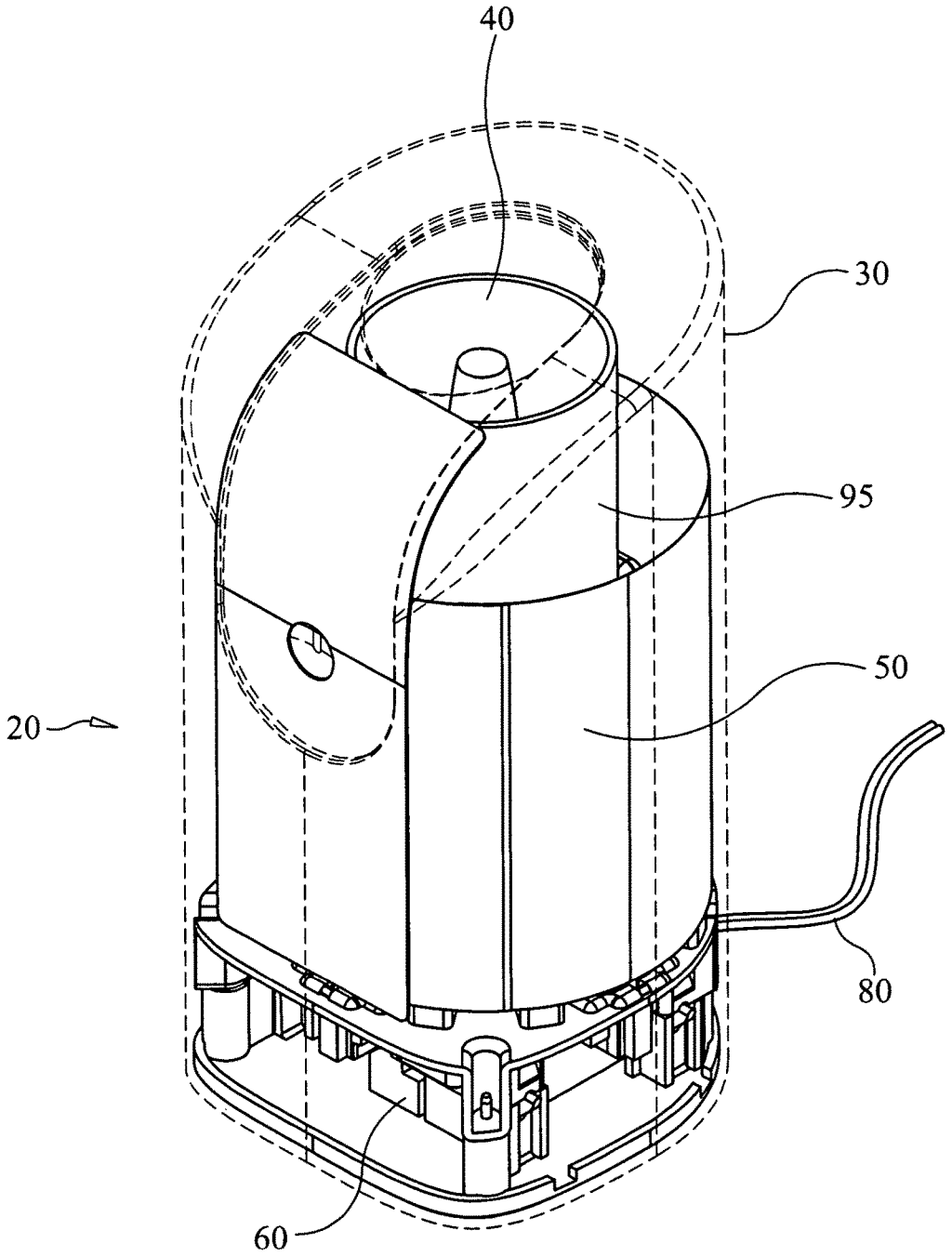
FIG. 2 depicts the preferred embodiment of the present invention as seen from the front corner with a transparent housing of the present invention.

As shown in FIG. 1, the present invention is a hair brush sanitizing and disinfecting device configured to rapidly and efficiently eliminate harmful microorganisms on a hair brush or tool specific to the art. The present invention is equipped with a body (20) which is bounded and circumscribed by a housing (30). The housing (30) is preferably composed of plastic or an acrylic polymer. A chamber (40) is disposed within the body (20), and the chamber (40) is configured to accept a hair brush or other similarly sized hair styling tool. At least one reflective panel (50) (as shown in FIG. 2, lines the interior of the chamber (40), preferably circumscribing the interior of the chamber (40). The at least one reflective panel (50) is preferably lightweight, and need not be a glass mirror, but rather any element equipped with an ample reflective surface.

Additionally, the body (20) of the present invention is equipped with a base (60). At least one UV lamp (70) (as shown in FIG. 3) is disposed on the base (60), and is housed within the housing (30) and within the chamber (40). The at least one UV lamp (70) is configured to cast ultraviolet light in a variety of wavelengths, frequencies, and directions within the chamber (40), which is reflected in a multitude of directions via the at least one reflective panel (50), ultimately casting maximal ultraviolet light onto bristles and a bristle base of a brush head (and brush handle—or any other hair utensil used) during sanitizing and disinfecting. As shown in FIG. 3, it should be noted that the preferred embodiment of the present invention is equipped with four iterations of the at least one UV lamp (70) as depicted.

The at least one UV lamp (70) is configured to cast UV-C light in wavelengths between 200 and 300 nanometers as an effective germicidal agent. UV light of this wavelength has been tested to successfully cause cell wall damage of microorganisms, and prevents their replication. It should be understood that the at least one UV lamp (70) of the present invention employs a conventional bulb socket and conventional UV bulb.

Additionally, the base (60) is preferably equipped with a power source (80), such as an AC power input, battery configured to be charged via an AC/DC adaptor, or other conventional means. Similarly, a power button (90) may be included on the base (60), as shown in FIG. 1, to facilitate activation of the present invention. Alternatively, the at least one UV lamp (70) of the present invention may be configured to activate automatically upon detection of a hair brush within the chamber (40) of the present invention. A conventional optical scanning mechanism be disposed within chamber (40) and placed in communication with power button (90) to cause activation of the at least one UV lamp (70).

The preferred process of use of the present invention, as seen in FIG. 7, is preferably as follows:

1. First, the user places a new or used brush, head or handle first, and places at least the brush head into the chamber (40) of the present invention. (200)
2. Next, the user activates the sanitizing and disinfecting process of the present invention by turning on the at least one UV lamp (70) via the power button (90). (210) Some embodiments of the present invention may be configured to automatically activate upon closure of a tab (85) that slides, and automatically deactivate upon sliding open tab (85). Similarly, some embodiments may be configured to automatically activate the at least one UV lamp (70) upon detecting the weight of the hair brush or other hair styling tool within the chamber (40) via conventional means.
3. The at least one UV lamp (70) sanitizes and disinfects all surfaces of the brush by emitting UV light, which is reflected within the chamber (40) via the at least one reflective panel (50). (220)
4. The at least one UV lamp (70) automatically deactivating after a user-determined time has elapsed (preferably 15 minutes based on testing with four UV lamps arranged as described below in combination with the other elements of the preferred embodiment of the present invention). (230)
5. The brush is now sanitized, disinfected, is ready for professional use on a new client. (240)

It should be noted that the at least one UV lamp (70) of the present invention is preferably arranged in an opposing, cardinal pattern similar to North, South, East, and West with four UV lamps. This orientation of the instantiations of the at least one UV lamp (70) of the present invention is ideal for reigning in the dimension of the at least one reflective panel (50) to a perfect size both for a salon station, as well as to ensure total 360 degree saturation of UV light. In testing, embodiments with only two UV lamps of the at least one UV lamp (70) require a reflective panel (50) with a much larger diameter than preferred to achieve a similar sanitizing effect to that of the present invention with four UV lamps. As such, without four UV lamps and extensive additions to the at least one reflective panel (50), the present invention would need to be much larger than desired in order to be effective, which is less than ideal for most salon stations. As such, four UV lamps of the at least one UV lamp (70) are preferably present in the base (60) of the present invention.

Supporting data for this orientation of the iterations of the at least one UV lamp (70) was gathered during substantial independent third party lab testing. Unlike conventionally accepted methods of determining sanitizing results, whereby predetermined forms called "coupons" (small pieces of steel or Teflon,) are inoculated with a pathogen, and are subsequently dosed with a chemical disinfectant, or in this case, UV light. All testing for the device of the present invention was conducted using hair brush "coupons." Therefore, results obtained are even more significant with respect to the disinfection of hair brushes. Relevant data supporting these scientific conclusions on the efficacy of the at least one UV lamp sanitizing a plurality of brush "coupons", contaminated with germs, bacterium, bacterial spores, and viruses, are exhibited below.

Summary of Log Reduction Data

| Test Article | Surface 1 Log reduction | Surface 1 % reduction | Surface 2 Log reduction | Surface 2 % reduction |
|---|---|---|---|---|
| Challege Organism: Methicillin Resistant *Staphylococcus aureus* (MRSa) | | | | |
| Grey Brush | 4.3 | 99.99527 | 5.7 | 99.99980 |
| Black Smooth Brush | 5.3 | 99.99954 | 5.2 | 99.99932 |
| Black Round Brush | 6.8 | 99.99999 | 6.3 | 100 |
| Boar Bristle Brush | 3.3 | 99.95364 | NA* | NA* |
| Challege Organism: *Escherichia coli* (*E. coli*) | | | | |
| Grey Brush | 3.3 | 99.95200 | 4.6 | 99.99767 |
| Black Smooth Brush | 4.9 | 99.99872 | 5.3 | 99.99948 |
| Black Round Brush | 6.6 | 99.99997 | 6.5 | 99.99997 |
| Boar Bristle Brush | 4.6 | 99.99763 | NA* | NA* |
| Challege Organism: *Listeria monocytogenes* (*L. monocytogenes*) | | | | |
| Grey Brush | 5.3 | 99.99952 | 5.2 | 99.99935 |
| Black Smooth Brush | 6.1 | 99.99992 | 6.1 | 100 |
| Black Round Brush | 5.5 | 99.99971 | 5.8 | 99.99985 |
| Boar Bristle Brush | 2.5 | 99.66667 | NA* | NA* |
| Challege Organism: *Geobacillus stearothermophilus* (GSTM) | | | | |
| Grey Brush | 4.4 | 99.99562 | 4.5 | 99.99685 |
| Black Smooth Brush | 2.7 | 99.81304 | 2.7 | 99.80556 |
| Black Round Brush | 2.7 | 99.80500 | 2.6 | 99.73684 |
| Boar Bristle Brush | 3.3 | 99.95154 | NA* | NA* |
| Challege Organism: *Aspergillus brasiliensis* (*A. brasiliensis*) | | | | |
| Grey Brush | 1.5 | 96.87500 | 3.2 | 99.94324 |
| Black Smooth Brush | 3.8 | 99.9835 | 3.8 | 99.98421 |
| Black Round Brush | 3.5 | 99.96703 | 3.4 | 99.95806 |
| Boar Bristle Brush | 2.4 | 99.57273 | NA* | NA* |

*material comparible to Black Smooth Brush, Surface 2.

Referring to FIG. 4, alternate embodiments of the present invention are preferably comprised of a raised and recessed end (1) configured to receive a brush head. The end (1) is sized and shaped to reflect UV light onto the brush head as shown in the FIGS. 4-6. The unit is preferably equipped with a transparent screen (2) in alternate embodiments of the present invention. The screen (2) serves as a surface for the brush to rest on. This transparent screen 2 may optionally have a UV sunscreen to protect its integrity from UV light that can damage plastics. A hospital grade UV light (3) is located in the base of the present invention. An aluminum sheet (4) is preferably disposed in both the base and top door of alternate embodiments of the present invention, and is operable to reflect UV light for full coverage and exposure of the brush. A unit base (5), houses a controller, power supply, such as batteries, and associated electronics, a power supply/charging port (6) is provided. Recessed grooves (7) show for the protrusion of a brush handle while the brush is inside the unit, which helps to contain the UV light safely inside the unit. Alternate embodiments of the present invention employ a top door (8) and a second UV light (9) disposed in the top door (8), as shown in FIG. 6. It should be understood that the preferred embodiments of the present invention are depicted in FIG. 1-3, and alternate embodiments of the present invention are shown in FIG. 4-6.

Further regarding the alternate embodiments disclosed in FIG. 4-6, as shown in FIGS. 5A and 5B, there is a rubber base (100) to prevent slippage at the bottom of the base (5). There is a hinge (110) on the rear (right side), shown in FIG. 5A. There is an on/off button (120) and a LCD timed display (10). The front, shown in FIG. 5C, is sized to accommodate round brushes and paddle brushes. The rear, shown in FIG. 2D, has a rear opening (140) for longer brush handles to protrude minimally to contain the UV light. As shown in FIG. 4, a brush handle protrusion (150) is shown to help to appreciate scale. An average brush will be six to 10 inches long. Size should be to accommodate paddle brushes four inches wide as well. Hospital grade UV light bulbs, one in the top door (8), and one in bottom, below the brush, are used. An aluminum sheet (4) is folded to 90 degrees, and is placed behind the bulbs to reflect the UV light.

Optionally, some embodiments of the present invention may be equipped with an LCD display (10) on an outer panel. Additionally, the present invention is preferably configured with one or more timed sequences for automatically terminating a brush sanitization process carried out by the present invention. Some embodiments of the unit may be shaped like a miniaturized tanning bed in appearance. The preferred embodiment of the present invention has a vertical alignment of the unit with a hair styling tool or hair brush can be inserted within an opening disposed on the top surface of the unit. Additionally, as aforementioned, the preferred embodiment of the present invention is equipped with a tab (85) disposed on the front/top of the present invention. The tab (85) is preferably user-replaceable, and is configured to match the décor of the user's workstation. As such, the tab (85) of the present invention is preferably available in a wide variety of colors, textures, and patterns. Most importantly, the tab, (85) has a depression so that a user's fingertip can fit into the depression to slide the tab (85) opened and closed to provide access to or close chamber (40). It should be understood that a user, while cutting someone's hair in a hair salon, would be holding someone's hair with a first hand while holding a brush with a second hand; and in such a scenario, the user could use but one finger of the second hand to slide tab (85) open and closed to begin sanitizing with the preferred embodiment present invention shown in FIG. 1-3.

Some embodiments may, for safety considerations, have the top door (8) equipped with a first piece of metal, the first piece of metal configured to mate with a second piece of metal on the unit, such that a circuit is closed when the top door (8) is closed, allowing the unit's UV light to operate. When the top door (8) is open, and hence, the circuit is open, the UV light cannot operate. The primary embodiment of the present invention shown in FIGS. 1-3 may also be equipped with this feature, which is preferably integrated into tab (85), such that tab (85) is preferably configured to activate the at least one UV lamp (70) when slid, and tab (85) acts as a sliding door configured to cover the opening of the chamber (40) of the present invention during the UV sanitation process. Additionally, some embodiments of the present invention include reflective panels including, but not limited to, thin aluminum panels placed directly behind the bulbs with high reflectivity for both light reflection and to prevent the damage of any plastic in the unit, as UV light can damage plastics in general. A front panel LCD display may count down the elapsed time remaining in the sanitizing process facilitated by the present invention.

Some embodiments of the present invention may be equipped with a scissor holder, which is preferably optionally bundled as an accessory to accompany the present invention, and facilitate use of the present invention to sanitize scissors. The scissor holder accessory is configured to maintain one or more pairs of scissors in the open position during sanitation within the chamber (40) of the present invention.

The unit may function either plugged into an outlet, or with batteries for a neat and uncluttered station. The term "hair styling tools" includes, but is not limited to, hair brushes, combs, scissors, hair pins, and any other items within use in the hair care industry.

Summarily, the following essential attributes should be understood as important to embodiments of the present invention: The chamber (40) of the present invention is oriented vertically, providing for the ideal presentation of any and all user-contacted surfaces (bristles) to the at least one UV lamp (70) of the present invention. The four-bulb configuration of the at least one UV lamp (70) as previously noted, is preferably disposed within close proximity of the hair styling tool to be sanitized in order to ensure sufficient UV saturation of all surfaces of the hair styling tool. Additionally, at least one reflective panel (50) surrounds the chamber (40) in order to maximize UV exposure from the at least one UV lamp (70) to the hair brush head or other styling tool placed within the chamber (40). It should be noted that while the present invention is described as particularly relating to hair brush heads, preferably an entire hairbrush is inserted in chamber (40) of the present invention; and instead of a hair brush, other hair styling tools could be inserted. The use of the at least one UV lamp (70) as a disinfecting agent eliminates the need for chemical disinfectants, and leaves no residual chemicals on any hair styling tool placed within the chamber (40). Likewise, disinfecting hair styling tools in this manner via UV light is much more ecologically-friendly than employing chemical disinfectants, as no chemicals are introduced into municipal water. A quartz barrier (95) is preferably present between the UV bulbs of the at least one UV lamp (70) and the hair styling tool to be disinfected. This is done in order to ensure that the range of the ultraviolet spectrum of light emitted from the at least one UV lamp (70) reaches the hair styling tool to be disinfected without impedance or loss by absorption to surfaces within the chamber (40). Other surfaces within the chamber (40) could be glass, plastic of the housing (30), or other materials subject to UV absorption or deterioration via UV light.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A device configured for sanitizing a hair styling tool comprising:

a body, said body having a housing circumscribing said body;

a base, said base disposed at a bottom of said body;

a first UV lamp;

a second UV lamp;

a third UV lamp;

a fourth UV lamp;

a chamber made of quartz, said chamber present within said housing and configured to surround said hair styling tool;

a power supply, said power supply contained within said base;

a power button, said power button disposed on an exterior of said housing;

at least one reflective panel;

wherein said at least one reflective panel is disposed between said housing and at least one of said UV lamps;

wherein said at least one reflective panel is configured to reflect ultraviolet light emitted from said first UV lamp, said second UV lamp, said third UV lamp, and said fourth UV lamp towards the hair styling tool;

wherein said chamber is configured to receive a hair styling tool in an inverted, vertical orientation;

wherein said first UV lamp, said second UV lamp, said third UV lamp, and said fourth UV lamp are disposed in a north, south, east west compass orientation when said chamber is viewed from above;

wherein said chamber is centrally disposed between said first UV lamp, said second UV lamp, said third UV lamp, and said fourth UV lamp;

wherein said first UV lamp, said second UV lamp, said third UV lamp, and said fourth UV lamp are configured to cast light 360 degrees within said chamber upon activation via said power button; and wherein at least one of said UV lamps is configured to automatically deactivate after a set time has elapsed.

2. The device of claim 1, wherein said housing is made of plastic.

3. The device of claim 1, wherein said first UV lamp, said second UV lamp, said third UV lamp, and said fourth UV lamp are aligned with respect to a vertical axis in said chamber.

4. The device of claim 1, further comprising:

said first UV lamp, said second UV lamp, said third UV lamp, and said fourth UV lamp automatically deactivating within 15 minutes.

5. The device of claim 1, wherein said first UV lamp, said second UV lamp, said third UV lamp, and said fourth UV lamp are florescent ultraviolet lamps.

6. The device of claim 1, further comprising one or more battery-powered sources.

7. The device of claim 1, further comprising a means of controlling a wavelength, frequency, and intensity of the plurality of ultraviolet light rays.

8. The device of claim 1, wherein the threshold of sanitization of the hair styling tool is specified by a user.

* * * * *